US007931303B2

(12) United States Patent
Steffen

(10) Patent No.: US 7,931,303 B2
(45) Date of Patent: Apr. 26, 2011

(54) COVERING SHEET FOR A PRINTED PRODUCT AND METHOD FOR PACKAGING NEWSPAPERS OR MAGAZINES BY MEANS OF SAID COVERING SHEET

(75) Inventor: Guido Steffen, Meilen (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 12/067,098

(22) PCT Filed: Sep. 18, 2006

(86) PCT No.: PCT/CH2006/000504

§ 371 (c)(1),
(2), (4) Date: Mar. 17, 2008

(87) PCT Pub. No.: WO2007/033510

PCT Pub. Date: Mar. 29, 2007

(65) Prior Publication Data

US 2008/0231039 A1 Sep. 25, 2008

(30) Foreign Application Priority Data

Sep. 19, 2005 (CH) ..... 1525/05

(51) Int. Cl.

| | |
|---|---|
| ***B42D 3/04*** | (2006.01) |
| ***B42D 1/00*** | (2006.01) |
| ***B42D 5/00*** | (2006.01) |
| ***B42D 3/00*** | (2006.01) |
| ***B42D 3/02*** | (2006.01) |
| ***B42D 7/00*** | (2006.01) |
| ***B42D 15/00*** | (2006.01) |

(52) U.S. Cl. ..... 281/19.1; 281/15.1; 281/17; 281/20; 281/29; 281/34; 281/35; 281/45; 283/56

(58) Field of Classification Search ..... 206/63.3, 206/232, 307, 308.1, 309, 311, 312, 313, 206/380, 472, 486; 229/70; 281/17, 19.1, 281/20, 29, 31, 45, 51, 15.1, 34, 35; 283/56, 283/64; 402/73; *B65D 85/57*

See application file for complete search history.

(56) References Cited

U.S. PATENT DOCUMENTS

| | | | | |
|---|---|---|---|---|
| 2,410,741 | A * | 11/1946 | Lesavoy | 281/34 |
| 4,160,687 | A | 7/1979 | Spear | |
| 5,178,414 | A * | 1/1993 | Small et al. | 281/29 |
| 5,632,476 | A | 5/1997 | Stauber | |
| 6,016,907 | A | 1/2000 | Dreier | |

FOREIGN PATENT DOCUMENTS

DE 201 14 260 U1 1/2002

(Continued)

*Primary Examiner* — Dana Ross
*Assistant Examiner* — Justin V Lewis
(74) *Attorney, Agent, or Firm* — Rankin, Hill & Clark LLP

(57) ABSTRACT

Printed products (2), in particular newspapers or magazines with different supplements are, for distribution, packed into a covering sheet e.g. made of paper. The covering sheet (1) comprises at least one region, which is completely punched-out and/or at least one region (7), which, due to a partial punching out is easily removable from the covering sheet (1). The punched-out region is a window (6), through which the title and/or the headline of a newspaper or magazine packed into the covering sheet (1) is visible. Partially punched-out regions (7) of the covering sheet (1) are marked by corresponding printing as voucher, reply card, collector's card, punch-out sheet or toy and are removed from the covering sheet (1) for functions other than the covering function of the covering sheet (1).

20 Claims, 3 Drawing Sheets

FOREIGN PATENT DOCUMENTS

| | | | |
|---|---|---|---|
| DE | 298 24 646 | U1 | 3/2002 |
| EP | 0 019 606 | A1 | 11/1980 |
| EP | 0 676 354 | A1 | 10/1995 |
| GB | 191930 | | 1/1923 |

* cited by examiner

COVERING SHEET FOR A PRINTED PRODUCT AND METHOD FOR PACKAGING NEWSPAPERS OR MAGAZINES BY MEANS OF SAID COVERING SHEET

BACKGROUND OF THE INVENTION

The invention is in the field of the further processing of printed products and pertains to a covering sheet according to the introductory portion of the first independent claim. The main function of the covering sheet is to bring together the printed product, which is, in particular, a newspaper or magazine with diverse supplements (e.g. further newspapers or magazines, prospectuses, brochures, CDs or other data carriers, sample objects) to form a unit, which is suitable for distribution, i.e. simple to handle. The invention additionally pertains to a method for wrapping newspapers or magazines by means of covering sheets.

The individual wrapping for distribution in particular of magazines possibly with supplements by means of an at least partly transparent plastic film and to seal the film around the newspaper is known. Thus a magazine ready for distribution is created, which is firstly protected from outside influences, in particular moisture and secondly guarantees that the magazine stays in new condition, which thirdly due to its transparency maintains the visibility of the magazine including promotional printing on its outside and which fourthly combines the magazine and supplements, which are inserted into or loosely added to the magazine to form a more or less stable and simply handlable unit. Printed products wrapped in this manner have become widely established, particularly where they are distributed by mail and are increasingly common, where the reader purchases them directly form the distributor (e.g. newsstand). It has also been suggested to offer daily newspapers wrapped in the named manner.

The named transparent plastic wrapping on the other hand has the disadvantage that it, as soon as the printed product has reached the reader, must be disposed of as waste and that the wrapping, by enclosure in plastic foil and sealing, is extremely time- and space-consuming. As known devices for wrapping normally have very restricted capacity, it is necessary to provide a plurality of wrapping devices operating in parallel for the on-line processing of e.g. the products ejected from a rotary printing press. These wrapping devices, together with the necessary means for their feeding, for subdivision of the stream of printed products laid out by the rotation, and the also necessary means for reuniting the branched streams represent considerable investment and require a large amount of space.

In publications U.S. Pat. No. 5,632,476, EP-0019606 or U.S. Pat. No. 4,160,687 it is suggested to improve the handlability of magazines by affixing at least one adhesive strip on the front cover, tensing it over an open magazine edge and then affixing it to the back cover. These adhesive strips hold together the magazine and, if applicable, supplements inserted therein in a unit, however, are in no way capable of protecting these when used without covering sheet.

In publication EP-0676354, it is also suggested to provide printed products such as e.g. magazines with a folded covering sheet and to seal this sheet in a suitable manner, such that again a unit suitable for distribution is created and the printed product is additionally protected, at least to a restricted degree. The covering sheet e.g. comprises a pre-fold, which, for the sealing, is applied to the edge of the magazine and is affixed on the opposite side, e.g. by means of gluing. The advantage of wrapping methods with the aid of covering sheets is that for wrapping, the same devices may be used as for the compiling of the printed product to be wrapped (e.g. device for inserting or collecting of printed product parts or of printed product and supplements), without having to substantially extend or adapt these devices for the additional functions. Known devices for the named processing steps also comprise capacities, which are sufficient for on-line processing of a stream of printed products laid out by a rotation, without subdivision. Like the plastic film, the covering sheet is also an object, which must be supplied in addition to the printed product and which, directly after delivery, must be disposed of in suitable manner by the recipient. Furthermore, compared to the plastic film, the covering sheet exhibits the disadvantage, that it is normally not transparent and thus would have to, if applicable, be printed on correspondingly for identification of the printed product.

BRIEF SUMMARY OF THE INVENTION

The invention now has the object to further develop the covering sheet described in short above, in particular for newspapers and magazines with supplements. The covering sheet according to the invention shall, as far as possible, unite the advantages of the named wrapping with transparent plastic film and the wrapping with a covering sheet and shall eliminate their disadvantages as far as possible. In other words, the covering sheet, according to the invention, shall be suitable to unite the printed product to form a simply handlable unit suitable for distribution and for at least a restricted degree of protection, wherein it shall be possible to identify the printed product in simple manner without a corresponding printing on the covering sheet, wherein the covering sheet according to the invention shall, nevertheless, make it possible to wrap the printed products with known devices and large capacities and wherein the covering sheet, according to the invention, shall in particular relevantly reduce the waste problem of the wrapping in plastic film or the known covering sheets. Furthermore, it is an object of the invention to provide a corresponding wrapping method.

These objects are achieved by the covering sheet or the unit consisting of covering sheet and printed product respectively, in particular the unit consisting of covering sheet, newspaper or magazine and supplements and by the method for wrapping of newspapers and magazines as they are defined in the claims.

The covering sheet according to the invention has, like known covering sheets, a rectangular or square format, which substantially has the double size of the printed product to be wrapped or a slightly larger size. The covering sheet according to the invention consists of paper or a plastic material having a stiffness approximately like paper and it is advantageously, again like known covering sheets, folded into a front side and a back side or it comprises an approximately central spine line with a structure, which allows easy folding or bending along this spine line. The covering sheet, according to the invention, additionally comprises a completely or partly punched-out region, wherein the punched-out region is, due to the punching out and possibly due to a corresponding printing, equipped for a function different to the covering or wrapping function respectively.

A completely punched-out region of the covering sheet, according to the invention, is in particular a window, through which relevant regions of the wrapped printed product, in particular title and/or headline of the wrapped newspaper or magazine are visible. A partly punched-out region of the covering sheet according to the invention, e.g. defined by a perforation line and, thus, easily removable from the covering sheet, is, e.g. by means of a corresponding printing or further provisions, equipped for further functions. This kind of removable region is e.g. a reply card, a voucher, a collector's item, a toy, (e.g. puzzle or punch-out sheet), a pocket for a CD or a different flat object or part of the named objects. The partial punching out of a region may also apply to a surface layer of a multi-layer covering sheet, wherein the surface layer is affixed to an inner layer by peelable means and the punched-out region can be peeled off and affixed somewhere else. As is yet to be shown a partially punched-out region may also be equipped as a means for sealing the covering sheet around the printed products packed within.

For packaging, the covering sheets according to the invention are positioned around the printed products to be packed for which purpose sheet and printed products are e.g. fed into an inserting system. Hereby, the covering sheets are inserted into the insertion compartments first and opened and then the printed products are inserted into the covering sheets. For sealing the covering sheets e.g. adhesive tape is used in an inherently known manner or adhesive-tape-like regions are created by spraying on of a plastic material. For sealing it is also possible to affix the regions protruding over the printed products to be packed by means of gluing or stitching them together with other regions. Where appropriate, the regions of the covering sheet equipped for sealing the covering sheet are prepared before the sealing step in a suitable manner by means of local reinforcement, application of adhesive, partial removal from the covering sheet, by folding and/or by unfolding. These kind of preparative steps may be carried out when manufacturing the covering sheets and/or directly before or during the packing.

The method according to the invention is carried out with the aid of an inserting system (e.g. inserting drum), wherein the inserting system is advantageously also equipped for the steps for sealing the covering sheet. It is also possible to bring the newspaper or magazine together with the covering sheet in an additional unit and to feed them into the inserting system together, wherein the supplements are inserted. The packing, and in particular the first step of the sealing, may also be carried out while the products are being conveyed by one or several gripper conveyors.

BRIEF DESCRIPTION OF THE DRAWINGS

The covering sheet according to the invention, which is particularly suited for packaging of newspapers or magazines together with diverse supplements and the packing method according to the invention are described in more detail in connection with the following figures, whereby

(FIG. 5: the covering sheet from the front; FIG. 6: the packed newspaper or magazine from the front; FIG. 7: the packed newspaper or magazine in section);

(FIG. 8: the packed newspaper or magazine from the front; FIG. 9: the packed newspaper or magazine in section).

DETAILED DESCRIPTION OF THE INVENTION

Figure 1:
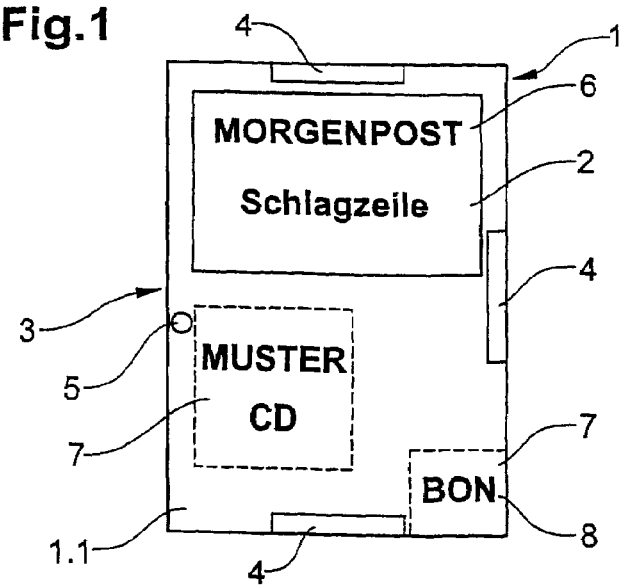
FIG. 1 shows an exemplified embodiment of a newspaper or magazine packed into a covering sheet according to the invention from the front.
Figure 2:
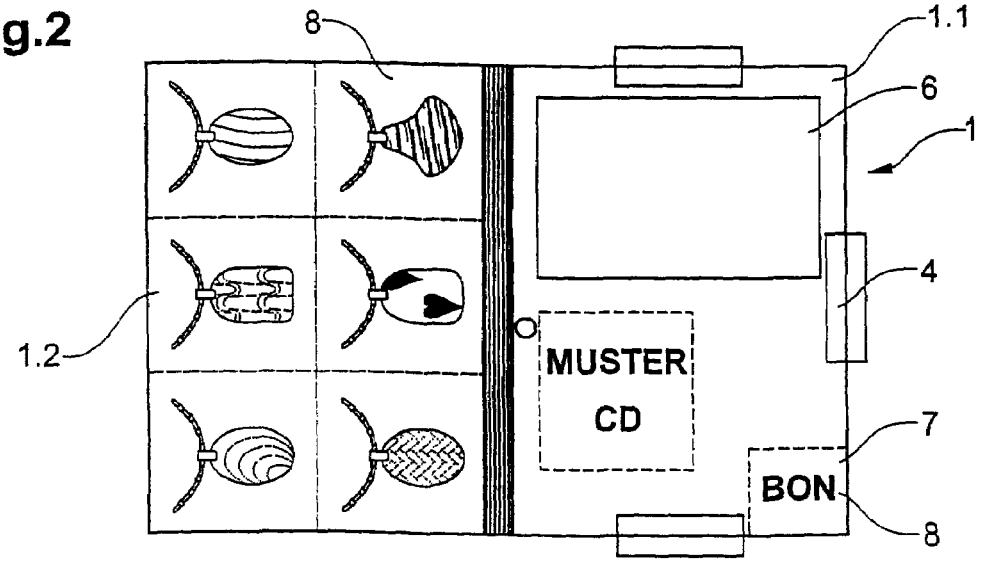
FIGS. 2 and 3 show the outside and the inside of a covering sheet according to FIG. 1.
Figure 3:
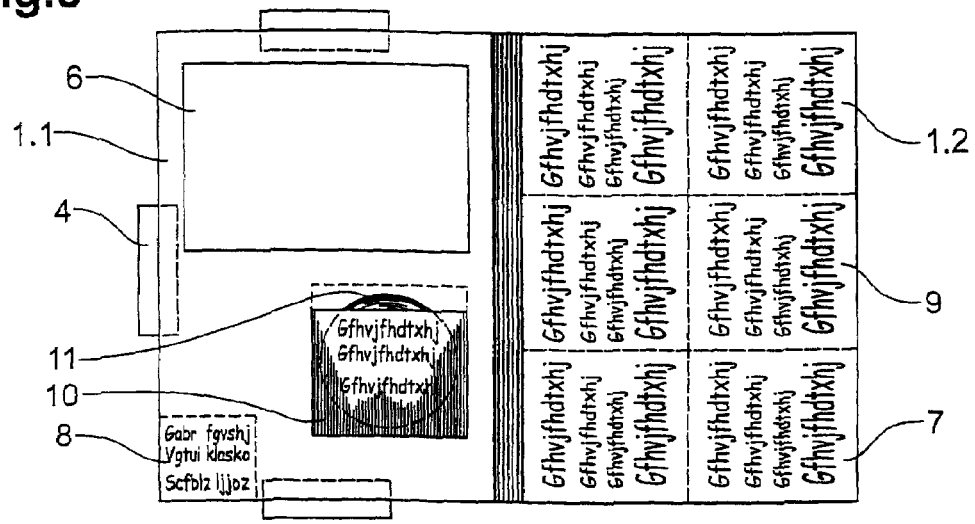

FIGS. 1 through 3 show a first exemplified embodiment of the covering sheet 1 according to the invention. In the shown case, the packed printed product 2 is a magazine or a newspaper in tabloid format, may, however, just as well be any other printed product such as e.g. a bound brochure or a doubly folded newspaper. Together with said printed product 2, any supplements or other printed products may be placed, wherein these are inserted into the first printed product and/or form a stack together with it. The covering sheet 1 comprises a front side 1.1 and a rear side 1.2, which are connected via a fold or spine line 3. The covering sheet is sealed to form a package in an inherently known manner, by means of adhesive strips 4 applied over the open sides. Additionally an electronic storage unit 5 identifying the contents may be arranged on the covering sheet 1.

The front side 1.1 of the covering sheet 1 comprises as a completely punched-out region a window 6, which is positioned such that e.g. the title and possibly the headline of the printed product 2 are visible through it. The window 6 is possibly covered by a transparent layer of material, wherein the transparent layer of material may be applied on the inside or the outside of the covering sheet.

In addition to the window 6, the covering sheet according to FIGS. 1 through 3 comprises only partially punched-out regions 7, which are e.g. enclosed by a perforated line and thus are easily removable from the covering sheet and which, in the case shown, are designed as vouchers 8 (front side of the covering sheet) or sheets of collector's cards 9 (rear side of the covering sheet) by means of possible printing on both sides. In the same manner e.g. reply cards or folded sheets for creating three-dimensional constructs (punch-out sheets) or flat regions 7 designed as toys and removable from the covering sheet by means of perforation may be provided.

A further only partially punched-out region 7 of the covering sheet according to FIGS. 1 through 3 is, by means of a pocket layer 10, applied to the inside of the covering sheet, equipped as a pocket for a CD 11 or a different flat object. The pocket (partially punched-out region 7 and possibly transparent pocket layer 10 adhering to it) may be open on one side or completely sealed and is easily removable from the covering sheet 1 as a whole. Naturally the pocket layer 10 may also be applied to the outside of the covering sheet 1.

The adhesive strips 4 shown in FIGS. 1 through 4, with the aid of which the covering sheets are sealed after insertion of the printed product are advantageously applied to the covering sheet before bringing together the covering sheet and the printed product and laid around the edge of the printed product and pressed against the opposite side after the bringing together. Obviously, instead of separate adhesive strips being applied, it is also possible to coat regions of the covering sheet protruding beyond the printed product or the edge of the covering sheet respectively with an adhesive and lay them over the edge of the printed product after the bringing together with the printed product and to fix them to the opposite side by means of adhesion or a different suitable manner of fastening. This kind of protruding region is advantageously formed and coated with adhesive before the covering sheet and the printed product are brought together (e.g. by means of cutting away or punching the adjacent regions).

Figure 4:
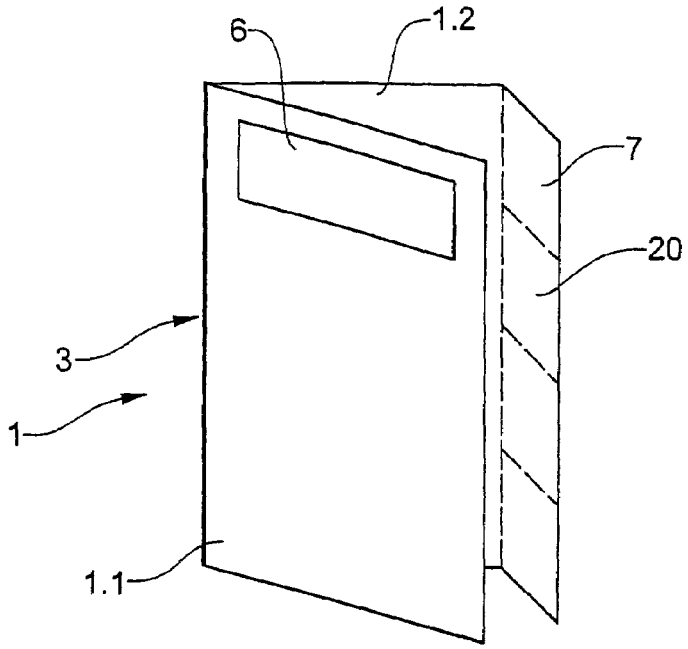
FIG. 4 shows a further exemplified embodiment of the covering sheet according to the invention.

FIG. 4 shows a covering sheet similar to the covering sheet 1 according to FIGS. 1 through 3, which again comprises a window 6 on its front side 1.1. Further, partly punched-out regions 7 are provided in region 20 of the rear side of the covering sheet protruding beyond front side 1.1, the protruding region 20 of the covering sheet advantageously being folded into the covering sheet and folded out for removal of the partially punched-out regions 7. Naturally, it is also possible to affix this kind of folded in region on the inside of the covering sheet 1 and, thus, to form one or several pockets, which, along a corresponding perforation line, are removable from the covering sheet 1 in one piece. A region 20 protruding beyond the rear side or the front side of the covering sheet 20, as shown in FIG. 4, may also at least partly serve as sealing means, by being laid over the edge of the printed product and being fastened to the opposite side of the covering sheet e.g. by means of adhesion. Thus, of the removable regions 20 shown in FIG. 4, e.g. the outer two could be coated with adhesive on their insides and for sealing the covering sheet 1, be affixed to its front side 1.1.

If the covering sheet region 20 protruding beyond the rear side 1.2, shown in FIG. 4, is folded inwards only after the covering sheet and the printed product have been brought together, it may, in an inherently known manner, be used, in the sense of a pre-fold for opening the covering sheet.

Figure 5:
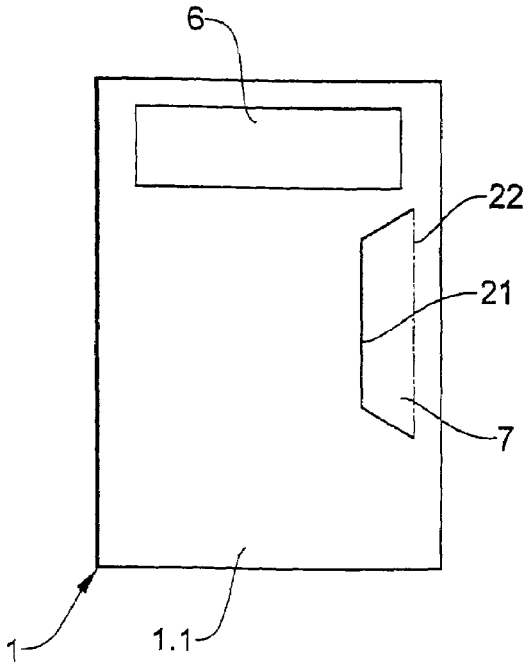
FIGS. 5 to 7 show a further exemplified embodiment of the covering sheet according to the invention with a partially punched-out region, which is equipped for the sealing function
Figure 6:
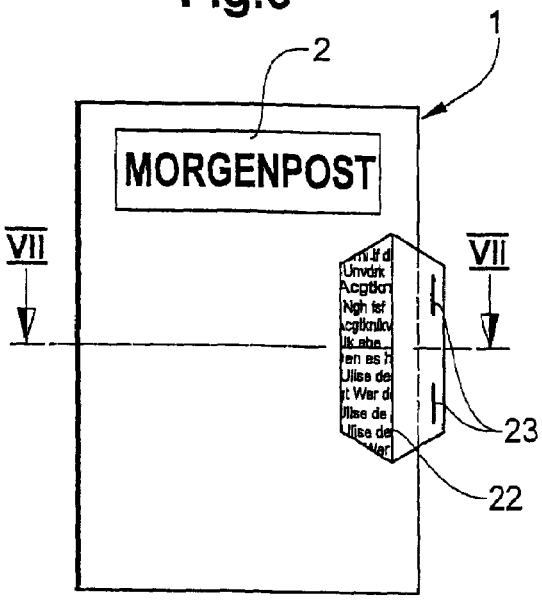
Figure 7:
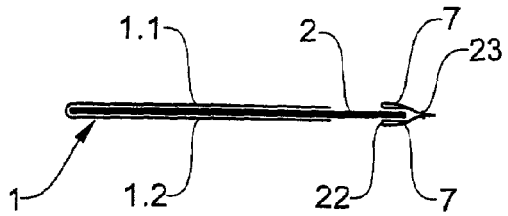

FIGS. 5 through 7 show a further exemplified embodiment of the covering sheet 1 according to the invention. FIG. 5 shows the empty covering sheet 1 from the front, FIGS. 6 and 7 show the sealed covering sheet 1 filled with a printed product 2, wherein it is viewed from the front in FIG. 6 and in section in FIG. 7 (section line VII-VII in FIG. 6).

In addition to a window 6, which is e.g. aligned to the title of the printed product 2, the covering sheet comprises two mutually aligned, partially punched-out regions 7, which are equipped for a sealing function. The partially punched-out regions 7, of which only the one on the front side 1.1 of the covering sheet 1 is visible in FIGS. 5 through 7, are defined by a cut 21 and a pre-folded line 22, the pre-folded line 22 being directed towards the edge of the covering sheet and designed for a folding of the region 7 towards the outside of the covering sheet. For sealing, the two partially punched-out regions 7 are folded outwards, laid over the edge of the covering sheet and connected to one another, e.g. by means of adhesion, embossing or stitching (clip 23), as can best be seen in FIG. 7.

Advantageously, the covering sheets are prepared for the sealing step directly before being brought together with the printed products, by moving the partially punched-out regions outwards and folding them. If necessary, the pre-folded lines 22 and, in particular, their end regions can be reinforced by application of a reinforcing layer.

Figure 8:
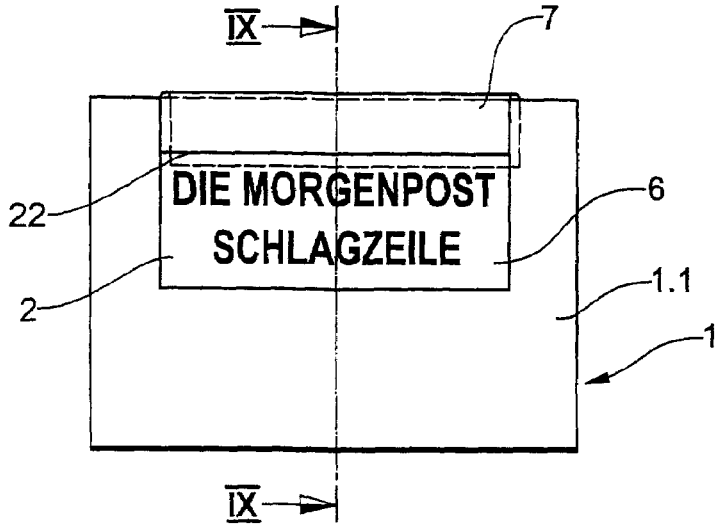
FIGS. 8 and 9 show a further exemplified embodiment of the covering sheet according to the invention with a partially punched-out region, which is equipped for a window and sealing function
Figure 9:
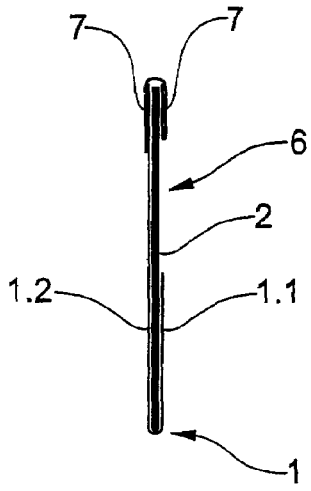

FIGS. 8 and 9 show a further exemplified embodiment of the covering sheet 1 according to the invention, in which a printed product 2 is readily packed. FIG. 8 shows the package from the front and FIG. 9 shows it in section (section line IX-IX, FIG. 8). The shown, not completely punched-out region 7 of the covering sheet 1 is simultaneously equipped for a window function and a sealing function. The region 7 is of the same size as a window to be provided for the title and/or headline of the printed product to be packed and is punched-out on three sides. The defining line 22 of the region 7 directed towards the edge is pre-folded. Before during or after the insertion of the printed product 2 into the covering sheet 1 the punched-out region 7 is folded outwards along the pre-folded defining line 22. For sealing the covering sheet 1 the partially punched-out region 7 is folded over the open edge of covering sheet 1 and printed product 2 and fastened on the rear side 1.2 of the covering sheet 1, e.g. by means of adhesion. In this embodiment it may again make sense to reinforce the region of the covering sheet between the pre-folded line 22 and the edge of the covering sheet with a suitable reinforcing layer.

Obviously, the characteristics of the covering sheets or the printed products packed in the covering sheets respectively shown in FIGS. 1 through 9 may also be combined differently than shown in the Figures. The shown means for sealing the covering sheet may be arranged on the edge opposite the folded spine of the covering sheet or also e.g. on all three open edges of the package. Correspondingly adapted means for sealing may also be provided in the corner regions opposite to the folded spine. Further embodiments of the covering sheet, which also belong to the invention, evolve from the named other combinations of characteristics and from the named variants of characteristics.

The invention claimed is:

1. A foldable or bendable covering sheet for a printed product, in particular for a newspaper or magazine with various supplements, which covering sheet, when folded or bent comprises:

a front side, and a rear side, wherein the covering sheet further comprises at least one flap which is a sealing region, with which the covering sheet is sealable in a condition folded or bent around a newspaper or magazine on at least one side, wherein the covering sheet defines at least one aperture having a predefined shape, the shape of the at least one flap matching that of the aperture;

wherein the at least one flap is partially enclosed by a pre-folded line in the covering sheet, and wherein the at least one flap is foldable or folded along the pre-folded line such that:

in a first position, the flap fits into and fills the aperture, and in a second position is fastenable or fastened to an opposite substantially identical flap or to an opposite side of the covering sheet.

2. The covering sheet according to claim 1, wherein a completely punched-out region is further provided, which constitutes a window, through which the title and/or headline of the newspaper or magazine are visible.

3. The covering sheet according to claim 1, wherein the at least one flap is arranged on the front side or the rear side of the covering sheet or on a region of this front or rear side, which is folded or foldable towards the inside.

4. The covering sheet according to claim 1, wherein the covering sheet is at least partly multilayered.

5. The covering sheet according to claim 4, wherein a second layer is a pocket layer, a transparent material layer or a reinforcing layer.

6. The covering sheet according to claim 1, wherein the at least one flap and at least one aperture are only within the surface layer of the covering sheet, which is multilayered.

7. Method for packing of newspapers or magazines possibly with supplements in one covering sheet each, comprising the steps of:

bringing the covering sheet and the newspaper or magazine together, such that the covering sheet is placed around the newspaper or magazine, sealing the covering sheet around the newspaper, preparing the covering sheet for the sealing before or after the bringing together and that as preparation, a flap, having a predetermined shape and which fits within an aperture in the cover sheet with an identical shape, is folded along a pre-folded line towards the outside.

8. A foldable or bendable covering sheet for a printed product, in particular for a newspaper or magazine with various supplements, which covering sheet, when folded or bent comprises:

a front side, a rear side, at least one flap which is enclosed by a first pre-folded line and at least one perforated line in the covering sheet and is partially detachable so as to be foldable or folded outwards along the first pre-folded line;

wherein the covering sheet is sealable in a condition folded or bent around a newspaper or magazine on at least one side by means of the at least one flap being fastenable or fastened to an opposite substantially identical flap or to an opposite side of the covering sheet.

9. The foldable or bendable covering sheet of claim 8, wherein the at least one flap is enclosed by a first pre-folded line, at least one perforated line, and at least one cut in the covering sheet.

10. The covering sheet of claim 1, wherein:

the front side is defined inside of at least three edges and a pre-folded line, wherein the pre-folded line is shared with the rear side;

the rear side is defined inside of at least three edges and the pre-folded line shared with the front side; and the at least one flap, when folded outwards, extends beyond the edges of front side or rear side.

11. The covering sheet of claim 1, wherein:

the front side is defined inside of at least three edges and a pre-folded line, wherein the pre-folded line is shared with the rear side;

the rear side is defined inside of at least three edges and the pre-folded line shared with the front side; and wherein the at least one flap seals the cover sheet along an edge of the front side and an edge of the rear side that are located opposite from the shared pre-folded line of the front and rear sides.

12. The covering sheet of claim 1 wherein the at least one flap includes an adhesive thereon.

13. The covering sheet of claim 8, wherein:

the front side is defined inside of at least three edges and a pre-folded line, wherein the pre-folded line is shared with the rear side;

the rear side is defined inside of at least three edges and the pre-folded line shared with the front side;

the at least one flap, when folded outwards, extends beyond the edges of front side.

14. The covering sheet of claim 8, wherein:

the front side is defined inside of at least three edges and a pre-folded line, wherein the pre-folded line is shared with the rear side;

the rear side is defined inside of at least three edges and the pre-folded line shared with the front side; and wherein the at least one flap seals the cover sheet along an edge of the front side and an edge of the rear side that are located opposite from the shared pre-folded line of the front and rear sides.

15. The covering sheet of claim 8 wherein the at least one flap includes an adhesive thereon.

16. The method of claim 7, wherein the flap includes an adhesive applied thereto.

17. The method of claim 7, further including the step of, after folding the flap, the covering sheet is sealed by attaching the flap to another flap of the covering sheet.

18. The method of claim 7, wherein:

the covering sheet includes a front side that is defined inside of at least three edges and a pre-folded line, wherein the pre-folded line is shared with a rear side of the covering sheet;

the rear side is defined inside of at least three edges and the pre-folded line shared with the front side; and the flap, when folded outwards, extends beyond the edges of front side or rear side.

19. The method of claim 7 wherein:

the covering sheet includes a front side that is defined inside of at least three edges and a pre-folded line, wherein the pre-folded line is shared with a rear side of the covering sheet;

the rear side is defined inside of at least three edges and the pre-folded line shared with the front side; and wherein the flap seals the covering sheet along an edge of the front side and an edge of the rear side that are located opposite from the shared pre-folded line of the front and rear sides.

20. The covering sheet of claim 1, wherein the covering sheet comprises two flaps and the covering sheet is sealable in a condition folded or bent around a newspaper or magazine by means of the first flap being fastenable or fastened to the second flap.

* * * * *